US009319782B1

(12) United States Patent
Crump et al.

(10) Patent No.: US 9,319,782 B1
(45) Date of Patent: Apr. 19, 2016

(54) DISTRIBUTED SPEAKER SYNCHRONIZATION

(71) Applicant: Rawles LLC, Wilmington, DE (US)

(72) Inventors: Edward Dietz Crump, Santa Cruz, CA (US); Philip Ryan Hilmes, San Jose, CA (US)

(73) Assignee: Amazon Technologies, Inc., Seattle, WA (US)

( * ) Notice: Subject to any disclaimer, the term of this patent is extended or adjusted under 35 U.S.C. 154(b) by 174 days.

(21) Appl. No.: 14/137,587

(22) Filed: Dec. 20, 2013

(51) Int. Cl.
*H04R 3/02* (2006.01)
*H04R 3/00* (2006.01)

(52) U.S. Cl.
CPC ..... *H04R 3/002* (2013.01)

(58) Field of Classification Search
CPC ..... G10K 11/175; H04R 27/00
USPC ..... 381/73.1
See application file for complete search history.

(56) References Cited

U.S. PATENT DOCUMENTS 7,418,392 B1 8/2008 Mozer et al.
7,720,683 B1 5/2010 Vermeulen et al.
7,774,204 B2 8/2010 Mozer et al.
2012/0223885 A1 9/2012 Perez
2014/0148224 A1* 5/2014 Truong ..... H04M 9/085 455/557

FOREIGN PATENT DOCUMENTS

WO WO2011088053 A2 7/2011

OTHER PUBLICATIONS

Pinhanez, "The Everywhere Displays Projector: A Device to Create Ubiquitous Graphical Interfaces", IBM Thomas Watson Research Center, Ubicomp 2001, Sep. 30-Oct. 2, 2001, 18 pages.

* cited by examiner

*Primary Examiner* — Simon King
(74) *Attorney, Agent, or Firm* — Lee & Hayes, PLLC

(57) ABSTRACT

Audio of electronic audio devices may be synchronized by a signal synchronization component that receives one or more signals corresponding to elements of the audio output by the electronic audio devices. The signal synchronization component may perform calculations to align signals corresponding to the output audio of the electronic audio devices and then determine a delay for the output audio transmitted from the electronic audio devices with respect to each other. Additionally, the signal synchronization component may operate in conjunction with audio sources of the electronic audio devices to modify the timing for transmitting output audio by one or more of the electronic audio devices based, at least in part, on the delay. In this way, the output audio transmitted by the electronic audio devices may be synchronized.

20 Claims, 7 Drawing Sheets

DISTRIBUTED SPEAKER SYNCHRONIZATION

BACKGROUND

Electronic audio devices may output sound, also referred to herein as audio, that corresponds to audio content played by the electronic audio devices. The quality of the sound may depend on a number of factors. For example, sound quality may be affected by features of the audio content, such as the equipment used to record the audio content, a sampling rate at which the audio content was recorded, bit depth of the audio content, and the like. Sound quality may also be affected by the features of the audio device used to play the audio content, such as the software used to playback the audio content, features of the speakers used to produce sound associated with the audio content, and so forth. In many situations, the user experience associated with an electronic audio device may be improved when distortions in sound output by the electronic audio device are minimized.

BRIEF DESCRIPTION OF THE DRAWINGS

The detailed description is described with reference to the accompanying figures. In the figures, the left-most digit(s) of a reference number identifies the figure in which the reference number first appears. The use of the same reference numbers in different figures indicates similar or identical components or features.

DETAILED DESCRIPTION

Figure 1:
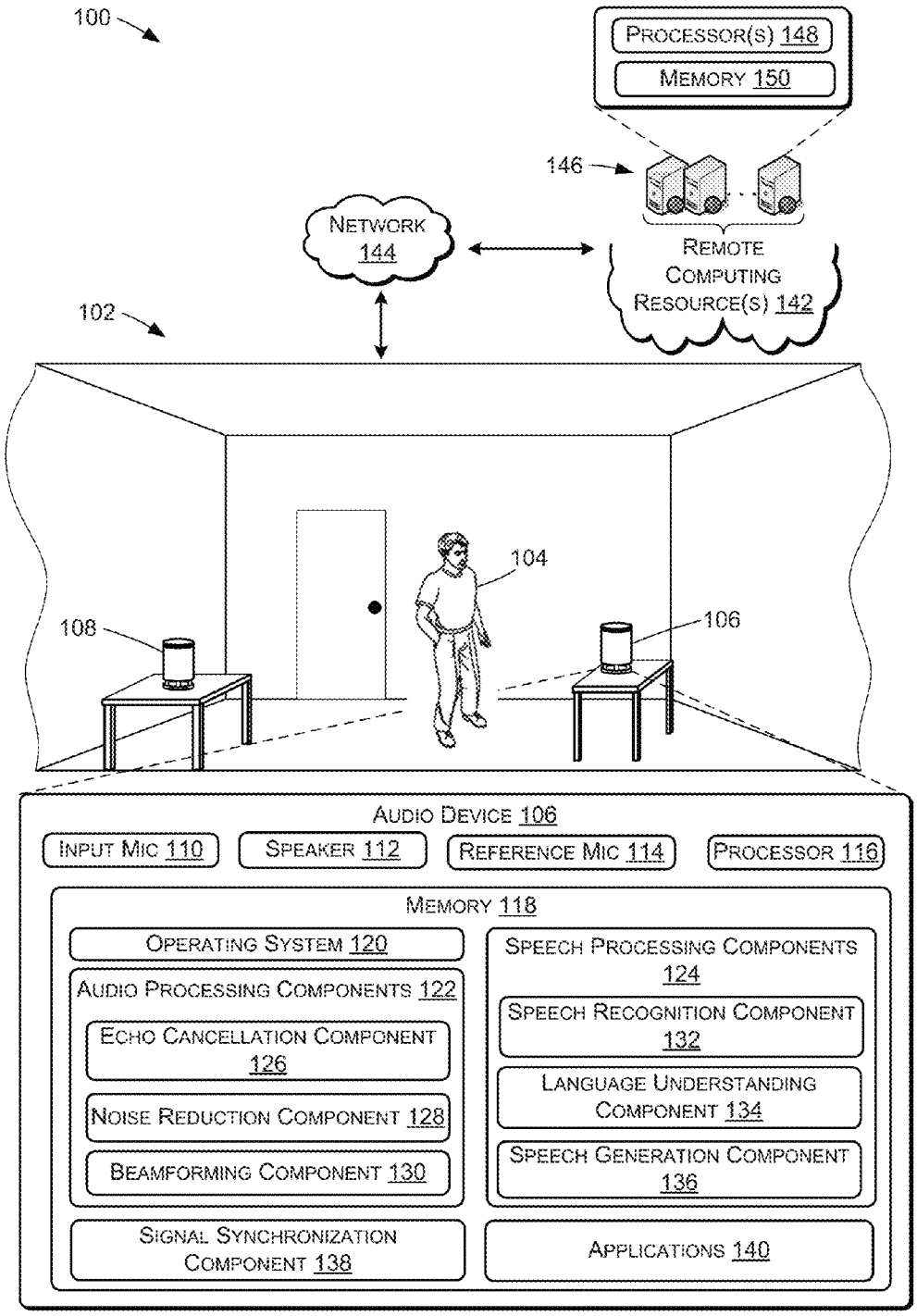
FIG. 1 illustrates an example environment that includes a number of electronic audio devices.

This disclosure includes techniques and implementations to improve sound quality for electronic audio devices. Sound quality may be improved by synchronizing audio transmitted by a plurality of electronic audio devices. In some cases, the audio transmitted by electronic audio devices may become asynchronous due to a rate at which the electronic audio devices output sound. In other situations, the audio may become asynchronous when audio content transmitted to the electronic audio devices for playback is received at different electronic audio devices at different times. Audio content may be received by different electronic audio devices at different times due to network delays in delivering the content to the electronic audio devices, such as due to wireless network transmission delays. In additional scenarios, audio may become asynchronous when a location of one of more electronic audio devices in an environment changes, when an electronic audio device is added to an environment, and/or when an electronic audio device is removed from an environment. When audio from multiple sources becomes asynchronous, the sound quality for the audio may decrease and the experience of a user in the environment may be negatively affected.

In an implementation, audio of electronic audio devices may be synchronized by a signal synchronization component that receives one or more signals that correspond to elements of the output audio transmitted by a number of electronic audio devices included in an environment. The signal synchronization component may perform calculations to align signals corresponding to the output audio of the electronic audio devices and then determine a delay for the output audio transmitted from the electronic audio devices with respect to each other. Additionally, the signal synchronization component may operate in conjunction with audio sources of the electronic audio devices to modify the timing for transmitting output audio by one or more of the electronic audio devices based, at least in part, on the delay. In this way, the output audio transmitted by the electronic audio devices may be synchronized. The synchronization of the output audio may improve the sound quality of the output audio and thereby improve the experience of a user in the environment.

In a particular implementation, a first electronic audio device and a second electronic audio device may be transmitting output audio into an environment. Microphones located in the environment may capture elements of the output audio. In some instances, the microphones may be included in the first electronic audio device and/or the second electronic audio device. In another implementation, the microphones may be included in an array of microphones that is remotely located from the first electronic audio device and the second electronic audio device.

A signal synchronization component may receive one or more input signals from the microphones that correspond to elements of first output audio transmitted by the first electronic audio device and elements of second output audio transmitted by the second electronic audio device. In some implementations, the signal synchronization component may be included in the first electronic audio device or the second electronic audio device. In other implementations, the signal synchronization component may be included in a computing device that is remote from the first electronic audio device and the second electronic audio device. The signal synchronization component may perform computations to align signals corresponding to the output audio of the first electronic audio device and the second electronic audio device. For example, the signal synchronization component may perform cross-correlation calculations to align respective signals corresponding to the first output audio of the first electronic audio device and the second output audio of the second electronic audio device.

In some cases, the signal synchronization component may determine that there is a delay between the output audio of the first electronic audio device and the second electronic audio device. The signal synchronization component may then operate in conjunction with an audio source that transmits audio associated with audio content to delay the transmission of output audio from the first electronic audio device or the second electronic audio device to align the output audio of the first electronic audio device and the second electronic audio device.

FIG. 1 illustrates an example environment 100 that includes a number of electronic audio devices. In particular, the environment 100 includes a room 102 having a user 104 and a plurality of electronic audio devices, such as a first audio device 106 and a second audio device 108. The user 104 may interact with the first audio device 106 and the second audio device 106, via one or more input devices of the first audio device 106 and the second audio device 108. In an implementation, the user 104 may interact with the first audio device 106 and the second audio device 108 to play audio content. In some cases, the first audio device 106 and the second audio device 108 may play the same audio content, while in other situations, the first audio device 106 and the second audio device 108 may play different content. In various implementations, the audio content played by the first audio device 106 and/or the second audio device 108 may be stored locally. In other situations, the audio content played by the first audio device 106, the second audio device 108, or both may be received from a computing device located remotely from the first audio device 106 and/or the second audio device 108. In a particular implementation, the audio content played by one or more of the first audio device 106 or the second audio device 108 may be an audio portion of multimedia content being played in the environment 100, such as audio content of a movie or television show being played in the environment 100.

The first audio device 106 may include one or more input microphones, such as input microphone 110 and one or more speakers, such as speaker 112. In some cases, the input microphone 110 and the speaker 112 may facilitate audio interactions with the user 104 and/or other users. The input microphone 110 of the first audio device 106, also referred to herein as an ambient microphone, may produce input signals representing ambient audio such as sounds uttered from the user 104 or other sounds within the environment 102. For example, the input microphone 110 may also produce input signals representing audio transmitted by the second audio device 108. The audio signals produced by the input microphone 110 may also contain delayed audio elements from the speaker 112, which may be referred to herein as echoes, echo components, or echoed components. Echoed audio components may be due to acoustic coupling, and may include audio elements resulting from direct, reflective, and conductive paths.

The audio device 106 may also include one or more reference microphones, such as the reference microphone 114, which are used to generate one or more output reference signals. The output reference signals may represent elements of audio content played by the first audio device 106 with minimal additional elements from audio of other sources. The output reference signals may be used by signal synchronization components, described in more detail below, to synchronize audio output from the first audio device 106 and the second audio device 108. The reference microphones may be of various types, including dynamic microphones, condenser microphones, optical microphones, proximity microphones, and various other types of sensors that may be used to detect audio output of the speaker 112.

The first audio device 106 includes operational logic, which in many cases may comprise one or more processors, such as processor 116. The processor 116 may include a hardware processor, such as a microprocessor. Additionally, the processor 116 may include multiple cores. In some cases, the processor 116 may include a central processing unit (CPU), a graphics processing unit (GPU), or both a CPU and GPU, or other processing units. Further, the processor 116 may include a local memory that may store program modules, program data, and/or one or more operating systems.

The first audio device 106 may also include memory 118. Memory 118 may include one or more computer-readable storage media, such as volatile and nonvolatile memory and/or removable and non-removable media implemented in any type of technology for storage of information, such as computer-readable instructions, data structures, program modules or other data. The computer-readable storage media may include, but is not limited to, RAM, ROM, EEPROM, flash memory or other memory technology, CD-ROM, digital versatile disks (DVD) or other optical storage, magnetic cassettes, magnetic tape, solid state storage, magnetic disk storage, storage arrays, network attached storage, storage area networks, cloud storage, removable storage media, or any other medium that can be used to store the desired information and that can be accessed by a computing device. The computer-readable storage media may also include tangible computer-readable storage media and may include a non-transitory storage media. The memory 118 may be used to store any number of functional components that are executable by the processor 116. In many implementations, these functional components may comprise instructions or programs that are executable by the processor 116 and that, when executed, implement operational logic for performing actions of the first audio device 106.

The memory 118 may include an operating system 120 that is configured to manage hardware and services within and coupled to the first audio device 106. In addition, the audio device 106 may include audio processing components 122 and speech processing components 124.

The audio processing components 122 may include functionality for processing input audio signals generated by the input microphone 110 and/or output audio signals provided to the speaker 112. As an example, the audio processing components 122 may include an acoustic echo cancellation or suppression component 126 for reducing acoustic echo generated by acoustic coupling between the input microphone 110 and the speaker 112. The audio processing components 122 may also include a noise reduction component 128 for reducing noise in received audio signals, such as elements of audio signals other than user speech.

In some embodiments, the audio processing components 122 may include one or more audio beamforming components 130 to generate an audio signal that is focused in a direction from which user speech has been detected. More specifically, the beamforming components 130 may be responsive to a plurality of spatially separated input microphones 110 to produce audio signals that emphasize sounds originating from different directions relative to the first audio device 106, and to select and output one of the audio signals that is most likely to contain user speech.

The speech processing components 124 receive an input audio signal that has been processed by the audio processing components 122 and perform various types of processing in order to recognize user speech and to understand the intent expressed the speech. The speech processing components 124 may include an automatic speech recognition component 132 that recognizes human speech in an audio signal. The speech processing components 124 may also include a natural language understanding component 134 that is configured to determine user intent based on recognized speech of the user. The speech processing components 124 may also include a text-to-speech or speech generation component 136 that converts text to audio for generation by the speaker 112.

Additionally, the memory 118 may also include a signal synchronization component 138 that is executable by the processor 116 to synchronize audio output from the first audio device 106 and the second audio device 108. The signal synchronization component 138 may receive one or more input audio signals that include portions elements corresponding to audio from the first audio device 106 and audio from the second audio device 108. The input audio signals may also include portions that correspond to user speech and/or audio from other sources (e.g., appliances, sound outside of the room 102, movement of the user 104, etc.).

After receiving an input audio signal that includes elements related to audio from the first audio device 106 and elements related to audio from the second audio device 106, the signal synchronization component 138 may align the portions of a signal associated with audio from the first audio device 106 and the portions of a signal associated with audio from the second audio device 108. In an implementation, the signal synchronization component 138 may utilize cross-correlation calculations to align the signal associated with the audio from the first audio device and the signal associated with audio from the second audio device 108. For example, a first signal corresponding to elements of audio from the first audio device 106 may be represented by a first function and a second signal corresponding to elements of audio from the second audio device 108 may be represented by a second function. In some cases, the audio from the first audio device 106 and the audio from the second audio device 108 may be produced from the same audio content, but be delayed by an amount of time with respect to each other. Continuing with this example, a cross-correlation function may be generated that estimates an amount of correlation between the first function and the second function at each of a number of delays. The cross-correlation function may indicate an amount to shift a function representing the elements of the audio from the second audio device 108 to match a function representing the elements of the audio from the first audio device 106. The signal synchronization component 138 may determine a delay between a time that audio was received from the first audio device 106 and a time that audio was received from the second audio device 108 using the one or more cross-correlation functions. In a particular implementation, the maximum of the cross-correlation function may indicate a delay between the audio from the first audio device 106 and the audio from the second audio device 108 because the maximum of the cross-correlation function may indicate the delay where the signal associated with the audio from the first device 106 and the signal associated with the audio from the second device 108 are the most similar or are the most correlated.

The delay between the audio from the first audio device 106 and the audio from the second audio device 108 that is calculated by the signal synchronization component 138 may be used to synchronize the audio of the first audio device 106 and the audio of the second audio device 108. To illustrate, the signal synchronization component 138 may operate in conjunction with an audio playback application 140 to delay playing audio content from the first audio device 106 for a period of time associated with the delay. By delaying the transmission of audio from the first audio device 106 for a period of time, the audio transmitted from the first audio device 106 may be substantially synchronized with audio transmitted from the second audio device 108.

The memory 118 may also include a plurality of applications 140 that work in conjunction with other components of the first audio device 106 to provide services and functionality. The applications 140 may include media playback services such as music players. Other services or operations performed or provided by the applications 140 may include, as examples, requesting and consuming entertainment (e.g., gaming, finding and playing music, movies or other content, etc.), personal management (e.g., calendaring, note taking, etc.), online shopping, financial transactions, database inquiries, and so forth. In some embodiments, the applications 140 may be pre-installed on the first audio device 106, and may implement core functionality of the first audio device 106. In other embodiments, one or more of the applications 140 may be installed by the user 104, or otherwise installed after the first audio device 106 has been initialized by the user 104, and may implement additional or customized functionality as desired by the user 104.

In certain embodiments, the primary mode of user interaction with the first audio device 106 is through speech, although the first audio device 106 may also receive input via one or more additional input devices, such as a touch screen, a pointer device (e.g., a mouse), a keyboard, a keypad, one or more cameras, combinations thereof, and the like. In an embodiment described herein, the first audio device 106 receives spoken commands from the user 104 and provides services in response to the commands. For example, the user 104 may speak predefined commands (e.g., "Awake"; "Sleep"), or may use a more casual conversation style when interacting with the first audio device 106 (e.g., "I'd like to go to a movie. Please tell me what's playing at the local cinema."). Provided services may include performing actions or activities, rendering media, obtaining and/or providing information, providing information via generated or synthesized speech via the first audio device 106, initiating Internet-based services on behalf of the user 104, and so forth.

In some instances, the first audio device 106 may operate in conjunction with or may otherwise utilize computing resources 142 that are remote from the environment 102. For instance, the first audio device 106 may couple to the remote computing resources 142 over a network 144. As illustrated, the remote computing resources 142 may be implemented as one or more servers or server devices 146. The remote computing resources 142 may in some instances be part of a network-accessible computing platform that is maintained and accessible via a network 144 such as the Internet. Common expressions associated with these remote computing resources 142 may include "on-demand computing", "software as a service (SaaS)", "platform computing", "network-accessible platform", "cloud services", "data centers", and so forth.

Each of the servers 146 may include processor(s) 148 and memory 150. The servers 146 may perform various functions in support of the first audio device 106, and may also provide additional services in conjunction with the first audio device 106. Furthermore, one or more of the functions described herein as being performed by the first audio device 106 may be performed instead by the servers 146, either in whole or in part. As an example, the servers 146 may in some cases provide the functionality attributed above to one or more of the audio processing components 122, the speech processing components 122, or the signal synchronization component 138. Similarly, one or more of the applications 140 may reside in the memory 150 of the servers 146 and may be executed by the servers 146.

The first audio device 106 may communicatively couple to the network 144 via wired technologies (e.g., wires, universal serial bus (USB), fiber optic cable, etc.), wireless technologies (e.g., radio frequencies (RF), cellular, mobile telephone networks, satellite, Bluetooth, etc.), or other connection technologies. The network 144 is representative of any type of communication network, including data and/or voice network, and may be implemented using wired infrastructure (e.g., coaxial cable, fiber optic cable, etc.), a wireless infrastructure (e.g., RF, cellular, microwave, satellite, Bluetooth®, etc.), and/or other connection technologies.

Although the audio device is described herein as a voice-controlled or speech-based device, the techniques described herein may be implemented in conjunction with various different types of devices, such as telecommunications devices and components, hands-free devices, entertainment devices, media playback devices, and so forth. Additionally, in some implementations, the second audio device 108 may include all or a portion of the components described with respect to the first audio device 106.

Figure 2:
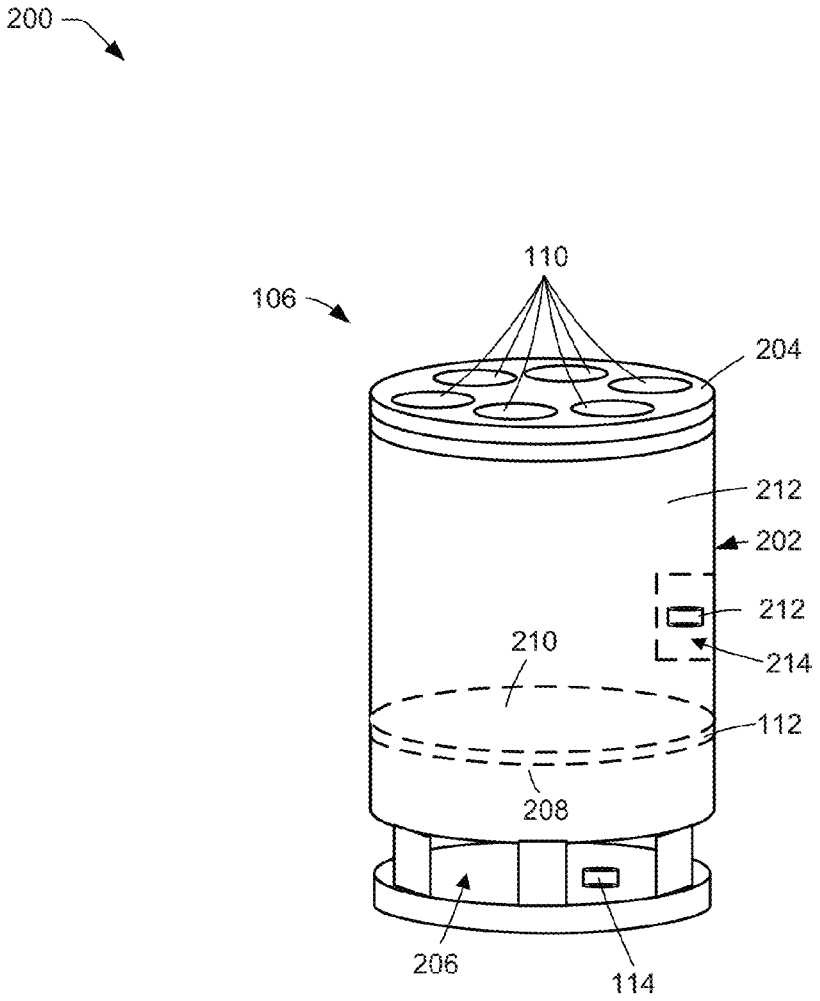
FIG. 2 is a perspective diagram of an example electronic audio device.

FIG. 2 illustrates an example embodiment of the first audio device 106. In this embodiment, the first audio device 106 comprises a cylindrical housing 202 for the input microphones 110, the speaker 112, the reference microphone 114, and other supporting components. The input microphones 110 are laterally spaced from each other so that they can be used by the audio beamforming components 130 of FIG. 1 to produce directional audio signals. In the illustrated embodiment, the input microphones 110 are positioned in a circle or hexagon on a top surface 204 of the housing 202. In various embodiments, the input microphones 110 may include greater or less than the number of microphones shown. For example, an additional microphone may be located in the center of the top surface 204 and used in conjunction with peripheral microphones for producing directionally focused audio signals.

The speaker 112 may be positioned within and toward the bottom of the housing 202, and may be configured to emit sound omnidirectionally, in a 360 degree pattern around the first audio device 106. For example, the speaker 112 may comprise a round speaker element directed downwardly in the lower part of the housing 202, to radiate sound radially through an omnidirectional opening or gap 206 in the lower part of the housing 202.

More specifically, the speaker 112 in the illustrative implementation of FIG. 2 has a front or front side 208 that faces down and that is open to the environment. The speaker 112 also has a back side 210 that faces up and that is not open to the environment. The housing 202 may form a closed or sealed space or chamber 212 behind the speaker 112. In some embodiments, the speaker 112 may have a directional audio output pattern that is designed to generate sound from the front of the speaker 112. The area in front of or below the speaker is within the directional output pattern and the area behind or above the speaker 112 is outside the directional output pattern.

FIG. 2 illustrates one of many possible locations of the reference microphone 112. In this embodiment, the reference microphone 114 is positioned below or substantially in front of the speaker 112, within or substantially within the directional output pattern of the speaker 112. The reference microphone 114 is further positioned in close proximity to the speaker 112 in order to maximize the ratio of speaker-generated audio to user speech and other ambient audio. To further increase this ratio, the reference microphone 114 may comprise a directional or unidirectional microphone, with a directional sensitivity pattern that is directed upwardly toward the front of the speaker 112. In some embodiments, the reference microphone 114 may comprise a directional proximity microphone, designed to emphasize sounds originating from nearby sources while deemphasizing sounds that originate from more distant sources.

The input microphones 110, on the other hand, are positioned above or substantially behind the speaker 112, outside of or substantially outside of the directional output pattern of the speaker 112. In addition, the distance from the input microphones 110 to the speaker 112 is much greater than the distance from the reference microphone 114 to the speaker 112. For example, the distance from the input microphones 110 to the speaker 112 may be from 6 to 10 inches, while the distance from the reference microphone 114 to the speaker 112 may be from 1 to 2 inches.

Because of the relative orientation and positioning of the input microphones 110, the speaker 112, and the reference microphone 114, audio signals generated by the input microphones 110 are relatively less dominated by the audio output of the speaker 112 in comparison to the audio signal generated by the reference microphones 114. More specifically, the input microphones 110 tend to produce audio signals that are dominated by user speech, audio from the second audio device 108, and/or other ambient audio, while the reference microphone 114 tends to produce an audio signal that is dominated by the output of the speaker 112. As a result, the magnitude of output audio generated by the speaker 112 in relation to the magnitude of audio generated by the second audio device 108 or the magnitude of other audio (e.g., user-generated speech, other ambient audio) is greater in the reference audio signal produced by the reference microphone 114 than in the input audio signals produced by the input microphones 110.

Additionally, or alternatively, the first audio device 106 may also include an additional reference microphone 212 positioned in the closed or sealed space 214 formed by the housing 202 behind the speaker 112. The additional reference microphone 212 may be attached to a side wall of the housing 202 in order to pick up audio that is coupled through the closed space 212 of the housing 202 and/or to pick up audio that is coupled conductively through the walls or other structure of the housing 202. Placement of the additional reference microphone 212 within the closed space 214 serves to insulate the additional reference microphone 212 from ambient sound, and to increase the ratio of speaker output to ambient sound in audio signals generated by the additional reference microphone 212.

Although FIG. 2 provides an illustrative implementation of the first audio device 106, the first audio device 106 may also have a variety of other microphone and speaker arrangements. For example, in some implementations, the speaker 112 may comprise multiple speaker drivers, such as high-frequency drivers (tweeters) and low-frequency drivers (woofers). In these situations, separate reference microphones may be provided for use in conjunction with such multiple speaker drivers. Furthermore, the second audio device 108 of FIG. 1 may also have an arrangement of microphones and speakers similar to or the same as the arrangement shown in FIG. 2.

Figure 3:
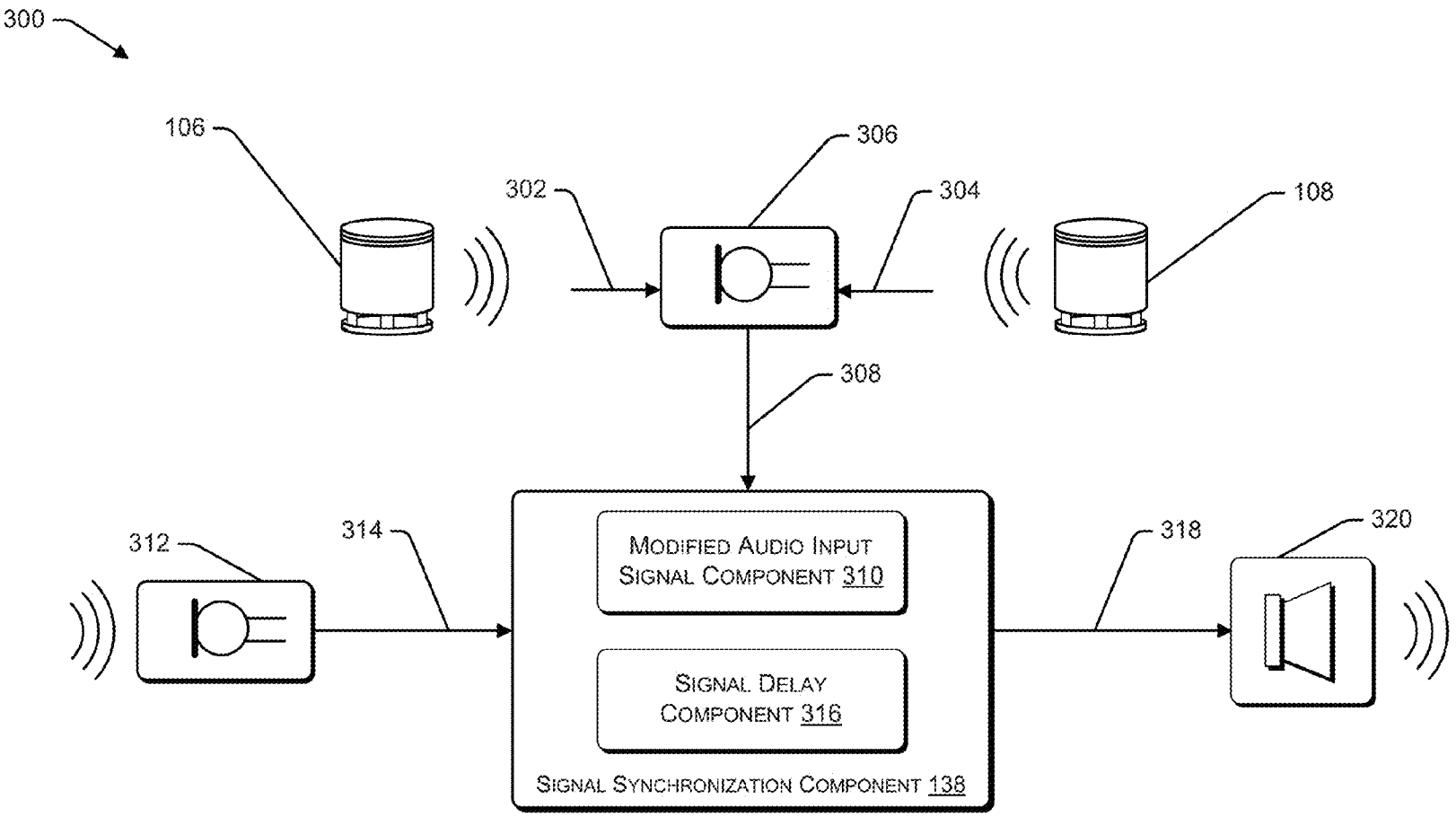
FIG. 3 illustrates an additional example environment that includes a signal synchronization component to synchronize audio received from multiple sources.

FIG. 3 illustrates an additional example environment 300 that includes a signal synchronization component to synchronize audio received from multiple sources. The environment 300 includes the first audio device 106 and the second audio device 108. The first audio device 106 transmits first audio 302 into the environment 300 and the second audio device 108 transmits second audio 304 into the environment 300.

The environment 300 also includes one or more microphones 306. In an implementation, the one or more microphones 306 may be included in an array of microphones located in the environment 300. In other implementations, the one or more microphones 306 may be included in the first audio device 106 or the second audio device 108. The one or more microphones 306 may receive the first audio 302 and the second audio 304. Additionally, the one or more microphones 306 may produce an input audio signal 308 that corresponds to first elements of the first audio 302 and second elements of the second audio 304. The first elements of the first audio 302, the second elements of the second audio 304, or both may include one or more sloped areas, such as peaks and valleys, corresponding to changes in frequency of the first audio 302 and/or the second audio 304 over time. In one example, peaks of elements of the first audio 302 and/or elements of the second audio 304 may include areas of maximum amplitude of a signal representing the first audio and valleys of elements of the first audio 302 and/or elements of the second audio 304 may include areas of minimum amplitude of a signal representing the second audio. In some cases, the input audio signal 308 may be represented by one or more functions that may be used to indicate the frequencies of the first audio 302 and the frequencies of the second audio 304 over time.

The environment 300 can include the signal synchronization component 138 that receives the input audio signal 308. The signal synchronization component 138 may include a modified audio input signal component 310 to modify the input audio signal 308. In an implementation, the modified audio input signal component 310 may include the echo cancellation component 126 of FIG. 1. In particular, the audio input signal component 310 may utilize an adaptive filter, such as a finite impulse response (FIR) filter, to remove elements from the audio input signal 308.

The environment 300 may also include one or more reference microphones 312 that may produce a reference signal 314. The reference signal 314 may include elements of the first audio 302 with minimal contributions from other audio or elements of the second audio 304 with minimal contributions from other audio. For example, the one or more reference microphones 312 may be positioned similar to the reference microphone 114 of FIG. 2 such that the magnitude of the first audio 302 is greater than a magnitude of the second audio 304 and/or the magnitude of audio from other sources.

In an implementation, the modified audio input signal component 310 may utilize the reference signal 314 to isolate elements of the second audio 304 from the audio input signal 308 to produce a modified audio input signal. In some cases, the modified audio input signal component 310 may isolate a portion of the elements of the second audio 304, such as at least about 60% of the elements of the second audio 304, at least about 75% of the elements of the second audio 304, or at least about 90% of the elements of the second audio 304. In some implementations, isolating elements of the second audio 304 from the audio input signal 308 may include subtracting portions of a signal corresponding to elements of the first audio 302 from the audio input signal 308. Thus, the modified audio input signal may correspond to a minimal number of elements of the first audio 302.

The modified audio input signal may correspond to elements of the second audio 304, elements of audio from other audio sources in the environment 300, or both. In a particular implementation, the modified audio input signal may primarily correspond to elements of the second audio 304. In some cases, the modified audio input signal may include portions that correspond to residual elements of the first audio 302 that were not removed by the modified audio input signal component 310. Additionally, the modified audio input signal component 310 may, in some scenarios, remove one or more portions of the audio input signal 308 that correspond to elements of the second audio 304 while removing the portions of the audio input signal 308 that correspond to elements of the first audio 302. Thus, in various implementations, the modified audio input signal may include one or more portions that correspond to the elements of the second audio 304 from the audio input signal 308, such as at least 60% of the elements of the second audio 304, at least 75% of the elements of the second audio 304, or at least 90% of the elements of the second audio 304.

The signal synchronization component 138 may also include a signal delay component 316 that determines a delay between receiving the first audio 302 and the second audio 304. In an implementation, the signal delay component 316 may determine the delay between the first audio 302 and the second audio 304 by aligning at least portions of the modified audio input signal with at least portions of the reference signal 314. For example, the signal delay component 316 may align one or more peaks of the modified audio input single with one or more peaks of the reference signal 314.

In a particular implementation, the signal delay component 316 may align portions of the modified audio input signal with portions of the reference signal 314 by performing cross-correlation calculations between the modified audio input signal and the reference signal 314. To illustrate, the modified audio input signal may be represented by a first function and the reference signal 314 may be modified by a second function. The signal delay component 316 may generate a cross-correlation function that indicates an amount of time to shift the first function with respect to the second function to align the portions of the modified audio input signal with the portions of the reference signal 316. The maximum of the cross-correlation function may indicate a delay where the portions of the modified audio input signal and the reference signal 314 have a maximum amount of correlation. Thus, the delay between the first audio 302 and the second audio 304 may then be determined based at least in part on the maximum of the cross-correlation function.

After determining a delay between the first audio 302 and the second audio 304, the signal delay component 316 may compare the delay to a threshold delay. In an implementation, the threshold delay may be at least about 0.1 milliseconds, at least about 0.5 milliseconds, at least about 1 millisecond, or at least about 5 milliseconds. In response to determining that the delay is less than the threshold delay, the signal delay component 316 may refrain from taking any action to adjust the timing of the first audio 302 or the second audio 304. Additionally, in response to determining that the delay is greater than or equal to the threshold delay, the signal delay component 316 may generate an amount of time to delay transmission of the first audio 302 to align the first audio 302 and the second audio 304 in time. In an illustrative implementation, the first audio 302 and the second audio 304 may be considered to be aligned in time or synchronized when the delay between the first audio 302 and the second audio 304 is less than the threshold delay.

Furthermore, in some situations, when the delay is greater than or equal to a threshold delay, the signal delay component 316 may align the first audio 302 and the second audio 304 incrementally over a period of time. For example, the signal delay component 316 may determine a first period of time to delay transmission of the first audio 302 and a second period of time to delay transmission of the first audio 302. In an implementation, the first period of time and the second period of time to delay transmission of the first audio 302 may add to a total delay for transmission of the first audio 302 determined by the signal delay component 316. In a particular example, the signal delay component 316 may cause a period of time of a first delay to occur at a first time and cause a period of time of a second delay to occur at a second time subsequent to the first time. In this way, the modification to the transmission of the first audio 302 may be performed gradually to minimize the audible effects of the modification.

In some cases, the transmission of the first audio 302 or the second audio 304 may be subjected to delays for additional periods of time. In an implementation, delaying transmission of the first audio 302 or the second audio 304 for additional periods of time may take place when the first audio 302 and the second audio 304 are being aligned with respect to different locations. For example, the signal delay component 316 may determine a delay between the first audio 302 and the second audio 304 according to implementations described previously and determine a period of time to delay transmission of the first audio 302 when aligning the first audio 302 and the second audio 304 with respect to the location of the first audio device 106. In another example, the signal delay component 316 may determine a delay between the first audio 302 and the second audio 304 and determine a period of time to delay the second audio 302 when aligning the first audio 302 and the second audio 304 with respect to a location of the second audio device 108.

In an additional implementation, the signal delay component 316 may align the first audio 302 and the second audio 304 to a location that is different from the location of the first audio device 106 and the second audio device 108. To illustrate, the signal delay component 316 may align the first audio 302 and the second audio 304 with respect to a midpoint between the first audio device 106 and the second audio device 108. The signal delay component 316 may also align the first audio 302 and the second audio 302 with respect to a location of a user in the environment 300. In some implementations, the location of a user in the environment 300 may be determined based on determining a location of speech of the user. In another implementation, data obtained by one or more cameras in the environment 300 may be used to determine the location of the user in the environment 300. In other implementations, the location of the user in the environment 300 may be determined by a location of an object held by or proximate to the user.

The signal delay component 316 may align the first audio 302 and the second audio 304 to a location different from the location of the first audio device 106 and the location of the second audio device 108 by delaying the transmission of the first audio 302 or the second audio 304 by an amount of time that is in addition to the amount of time that the first audio 302 or the second audio 304 are delayed when aligning the first audio 302 and the second audio 304 with respect to the location of the first audio device 106 or the second audio device 108. For example, the signal delay component 316 may determine a period of time to delay transmission of the first audio 302 to align the first audio 302 and the second audio 304 with respect to the location of the first audio device 106. The signal delay component 316 may then obtain information indicating a location of a user in the environment 300, such as information obtained from one of the applications 140 of FIG. 1. The signal delay component 316 may also calculate or obtain a distance between the user in the environment 300 and the location of the first audio device 106 and/or a distance between the user and the location of the second audio device 108. In some cases, the distance between the user and the location of the first audio device 106 may be different from the distance between the user and the location of the second audio device 108. Based at least in part on the distance between the user and the location of the first audio device 106 and the distance between the user and the location of the second audio device 108, the signal delay component 316 may determine a first additional period of time to delay transmission of the first audio 306, a second additional period of time to delay transmission of the second audio 304, or both. Thus, in one example, the signal delay component 316 may be configured to modify the transmission of the first audio 302 by the period of time to align the first audio 302 and the second audio 304 to the location of the first audio device 106 and also by the first additional period of time to align the first audio 302 and the second audio 304 with the location of the user. Aligning the first audio 302 and the second audio 304 with the location of the user may also include delaying transmission of the second audio 304 by the second additional period of time.

The signal delay component 316 may output a delay signal 318 to a speaker 320 or to an audio source including the speaker 320. In an example, the delay signal 318 may indicate a period of time to delay transmission of audio from the audio source to align the audio with additional audio that is in the environment 300. To illustrate, the speaker 320 may be included in the first audio device 106, and the delay signal 318 may indicate a period of time to delay transmission of the first audio 302 to align the first audio 302 with the second audio 304.

Figure 4:
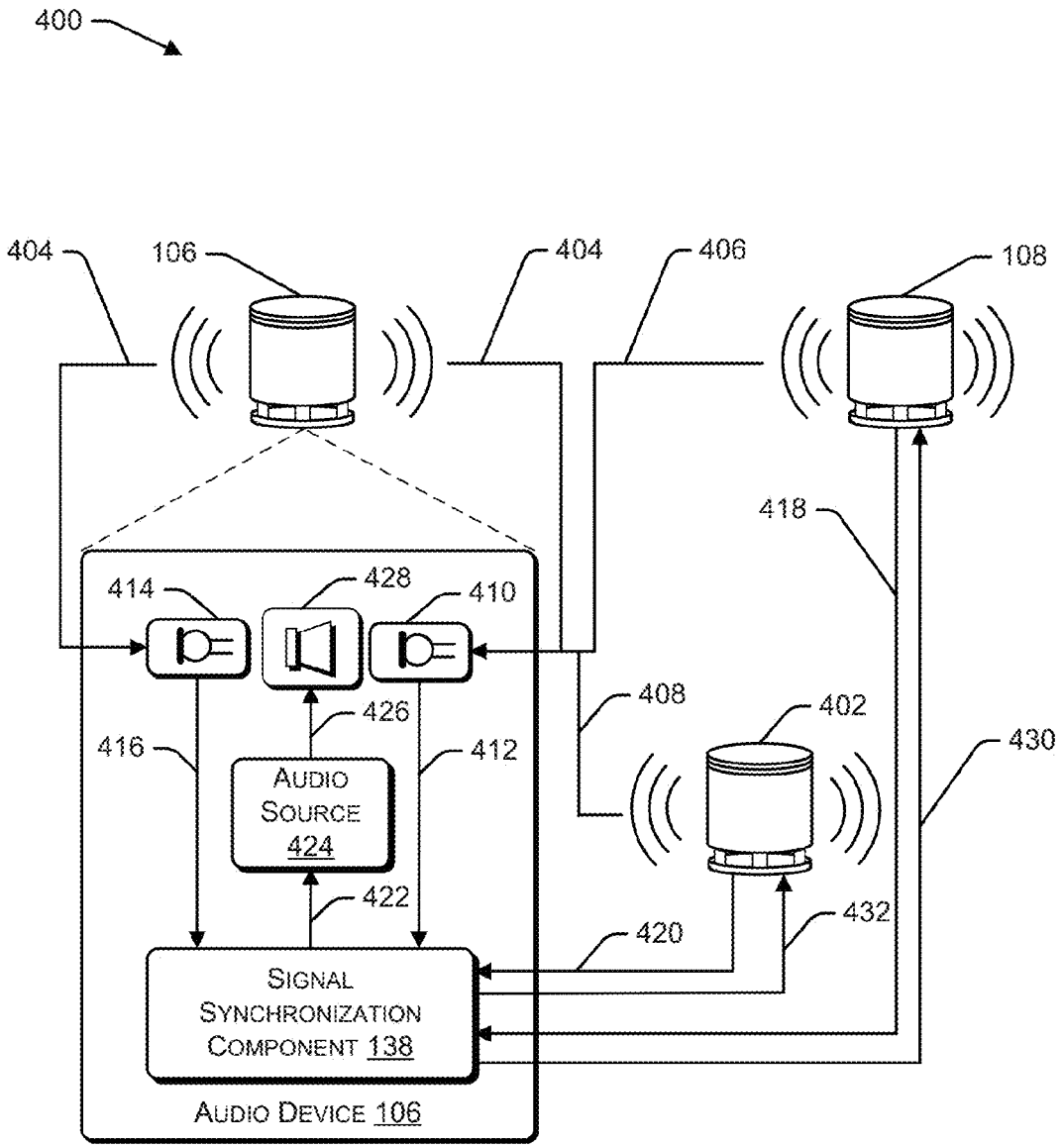
FIG. 4 illustrates another example environment including an electronic audio device that captures sounds and produces a number of audio signals that are used by a signal synchronization component to synchronize audio received from multiple electronic audio devices.

FIG. 4 illustrates another example environment 400 multiple electronic audio devices and a signal synchronization component to synchronize audio of the multiple electronic audio devices. In particular, the environment 400 includes a first audio device 106, a second audio device 108, and a third audio device 402. The first audio device 106 produces first audio 404, the second audio device 108 produces second audio 406, and the third audio device 402 produces third audio 408. In some cases, the first audio 404, the second audio 406, and the third audio 408 may be produced from the same audio content. For example, the first audio 404, the second audio 406, and the third audio 408 may be produced when a particular song is being played via the first audio device 106, the second audio device 108, and the third audio device 402. Although, the signal synchronization component 138 is shown to be included in the first audio device 106, in some cases, the second audio device 108, the third audio device 402, or both may additionally include a respective signal synchronization component.

In an implementation, the first audio device 106 may include an input microphone 410 that receives the first audio 404, the second audio 406, and the third audio 408 and generates an audio input signal 412. The audio input signal 412 may correspond to one or more of elements of the first audio 404, elements of the second audio 406, or elements of the third audio 408. The audio input signal 412 may be sent to the signal synchronization component 138.

The first audio device 106 may also include a reference microphone 414 that sends a first reference signal 416 to the signal synchronization component 138. In an implementation, the reference microphone 414 receives the first audio 404. In some cases, the reference microphone 414 may also receive the second audio 406 and/or the third audio 408. In these situations, the magnitude of the second audio 406 and/or the magnitude of the third audio 408 is less than the magnitude of the first audio 404 in the first reference signal 416. The reference microphone 414 may send a first reference signal 416 to the signal synchronization component 138.

The signal synchronization component 138 may also receive a second reference signal 418 from the second audio device 108. The second reference signal 418 may correspond to elements of the second audio 406. In a particular implementation, the second reference signal 418 may also correspond to elements of the first audio 404 and/or elements of the third audio 408. In these instances, the magnitude of the first audio 404 and/or the third audio 408 in the second reference signal 418 is less than the magnitude of the second audio 406 in the second reference signal 418. In an illustrative implementation, the second reference signal 418 may be generated by a reference microphone of the second audio device 108.

Additionally, the signal synchronization component 138 may also receive a third reference signal 420 from the third audio device 402. The third reference signal 420 may indicate elements of the third audio 408. In a particular implementation, the third reference signal 420 may also correspond to elements of the first audio 404 and/or elements of the second audio 406. In these instances, the magnitude of the first audio 404 and/or the second audio 406 in the third reference signal 420 is less than the magnitude of the third audio 408 in the third reference signal 420. In an illustrative implementation, the third reference signal 420 may be generated by a reference microphone of the third audio device 402.

The signal synchronization component 138 may determine one or more delays between the first audio 404, the second audio 406, and the third audio 408. For example, the signal synchronization component 138 may determine a first delay between the first audio 404 and the second audio 406, a second delay between the first audio 404 and the third audio 408, and a third delay between the second audio 406 and the third audio 408. In an implementation, the signal synchronization component 138 may determine the first delay by removing portions of the audio input signal 412 corresponding to elements of the first audio 404 from the audio input signal 412 using the first reference signal 414 and removing portions of the audio input signal 412 corresponding to elements of the third audio signal 408 using the third reference signal 420 to produce a first modified audio input signal. The signal synchronization component 138 may then determine an amount of time needed to align the first modified audio input signal with the first reference signal 414, such as via cross-correlation calculations, and determine the first delay between the first audio device 106 and the second audio device 108.

In another implementation, the signal synchronization component 138 may determine the second delay by removing portions of the audio input signal 412 corresponding to elements of the first audio 404 from the audio input signal 412 using the first reference signal and removing portions of the audio input signal 412 corresponding to elements of the second audio 406 from the audio input signal 412 using the second reference signal 418 to produce a second modified audio input signal. The signal synchronization component 138 may then determine an amount of time needed to align the second modified audio input signal with the first reference signal 414, such as via cross-correlation calculations, and determine the second delay between the first audio device 106 and the third audio device 402. Further, the signal synchronization component 138 may determine the third delay by removing portions of the audio input signal corresponding to elements of the first audio 406 using the first reference signal 414 and removing portions of the audio input signal corresponding to elements of the second audio 408 from the audio input signal 412 using the second reference signal 418 to produce a third modified audio input signal. In a particular implementation, the signal synchronization component 138 may determine an amount of time needed to align the third modified audio input signal with the second reference signal 418 and determine the third delay between the second audio device 108 and the third audio device 402.

After determining the first delay between the first audio 404 and the second audio 406, the second delay between the first audio 404 and the third audio 408, and the third delay between the second audio 406 and the third audio 408, the signal synchronization component 138 may determine the delay with the highest value. The signal synchronization component 138 may then synchronize the first audio 404, the second audio 406, and the third audio 408 around the delay with the highest value. In this way, the audio device producing audio output that is most delayed with respect to audio from another one of the audio devices does not have its output adjusted, but the audio produced by the other audio devices is adjusted to synchronize with the audio device having the delay with the highest value.

The signal synchronization component 138 may send a respective delay signal to one or more of the audio devices 106, 108, or 402 to synchronize the audio produced by the first audio device 106, the second audio device 108, and the third audio device 402. For example, the signal synchronization component 138 may, in some scenarios, send a first delay signal 422 to an audio source 424 of the first audio device 106 to delay transmission of the first audio 404. The audio source 424 may include one or more applications of the first audio device 106 that play audio content. Upon receiving the first delay signal 422, the audio source 424 may send audio output signals 426 to the speaker 428 that are delayed by a period of time to synchronize the first audio 404 with the second audio 406 and the third audio 408. Additionally, the signal synchronization component 138 may send a second delay signal 430 to the second audio device 108 such that an audio source of the second audio device 108 may delay transmission of the second audio 406 for a particular period of time to synchronize the second audio 406 with the first audio 404 and the third audio 408. Further, the signal synchronization component 138 may send a third delay signal 432 to the third audio device 402 such that an audio source of the third audio device 402 may delay transmission of the third audio 408 for a specified period of time to synchronize the third audio 408 with the first audio 404 and the second audio 406.

In an illustrative implementation, the signal synchronization component 138 may determine that the third audio 408 is delayed by about 3 milliseconds with respect to the first audio 406 and that the third audio 408 is delayed by about 2 milliseconds with respect to the second audio 406. The signal synchronization component 138 may also determine that the second audio 406 is delayed by about 1 millisecond with respect to the first audio 404. In this scenario, the third audio 408 produced by the third audio device 402 is not adjusted, while the first audio 404 and the second audio 406 are adjusted to be synchronized with the third audio 408. In particular, the first audio 404 is delayed by about 2 milliseconds with respect to the third audio 408 and the second audio 406 is delayed by about 1 millisecond with respect to the third audio 408 to synchronize the first audio 404, the second audio 406, and the third audio 408. In this illustrative implementation, the signal synchronization component 138 may send the first delay signal 422 to the audio source indicating a delay of 2 milliseconds for the first audio 404 to be aligned with the third audio 408. The signal synchronization component 138 may also send the second delay signal 430 to the second audio device 106 indicating a delay of 1 millisecond for the second audio 406.

Figure 5:
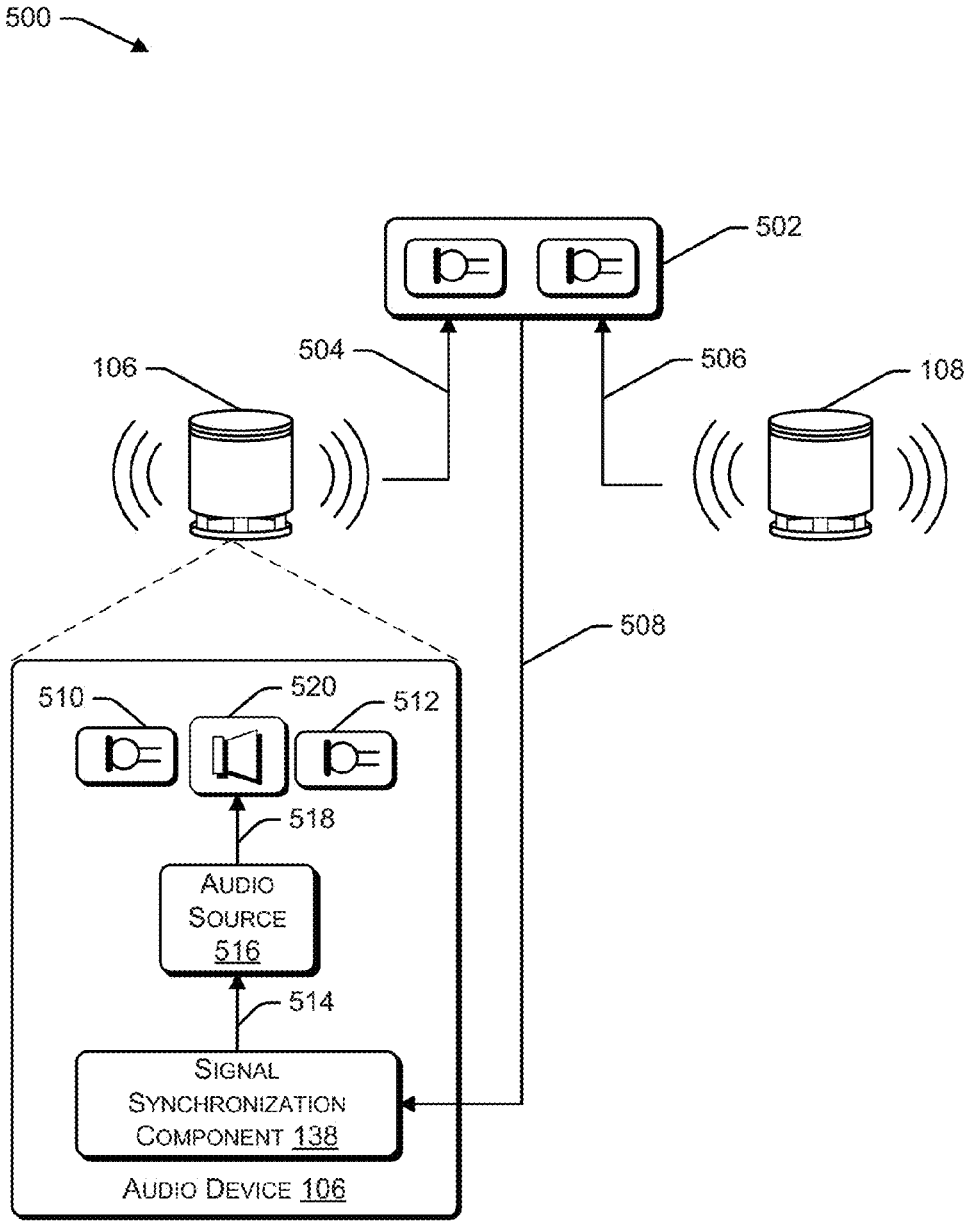
FIG. 5 illustrates a further example environment including a remote microphone array and an electronic audio device that includes a signal synchronization component that receives signals from the remote microphone array and/or from an additional electronic audio device to synchronize audio transmitted by different sources.

FIG. 5 illustrates a further example environment 500 including a remote microphone array 502 and the first audio device 106 that includes a signal synchronization component 138 that receives signals from the remote microphone array 502 and/or from the second electronic audio device 108 to synchronize audio transmitted by the first audio device 106 and the second audio device 108. In an implementation, the first audio device 106 may produce first audio 504 and the second audio device 108 may produce second audio 506. The remote microphone array 502 may receive the first audio 504 and the second audio 506 and generate an audio input signal 508 that is transmitted to the signal synchronization component 138. The audio input signal 508 may correspond to elements of the first audio 504 and elements of the second audio 506.

In an illustrative implementation, the signal synchronization component 138 may determine a delay between the first audio 504 and the second audio 506 using the audio input signal 508. For example, the signal synchronization component 138 may remove portions of the audio input signal 508 corresponding to elements of the first audio 504 from the audio input signal 508 to produce a modified audio input signal. The removal of the portions of the audio input signal 508 corresponding to elements of the first audio 502 from the audio input signal 508 may be performed using a reference signal produced by a reference microphone 510 of the first audio device 106. In some situations, the first audio device 106 may also include an input microphone 512. In a particular implementation, the input microphone 512 may receive the first audio 504 and the second audio 506 and produce an additional audio input signal that is sent to the signal synchronization component 138. The additional audio input signal may be used in place of or in conjunction with the audio input signal 508 to synchronize the first audio 504 and the second audio 506.

After removing elements portions of the audio input signal 508 corresponding to elements of the first audio 504 from the audio input signal 508, the signal synchronization component 138 may perform calculations to align portions of the modified audio input signal with portions of the reference signal. A delay between the first audio 502 and the second audio 504 may then be determined based at least in part on an amount of a shift for the portions of the modified audio input signal to be aligned with the portions of the reference signal. The signal synchronization component 138 may send a delay signal 514 to an audio source 516, where the delay signal 514 indicates an amount of time to delay transmission of the first audio 504 with respect to the second audio 506. The audio source 516 may generate audio output signals 518 that are delayed by the amount of time corresponding to the delay between the first audio 502 and the second audio 504. The audio output signals 518 are sent to the speaker 520 to be transmitted into the environment 500.

Figure 6:
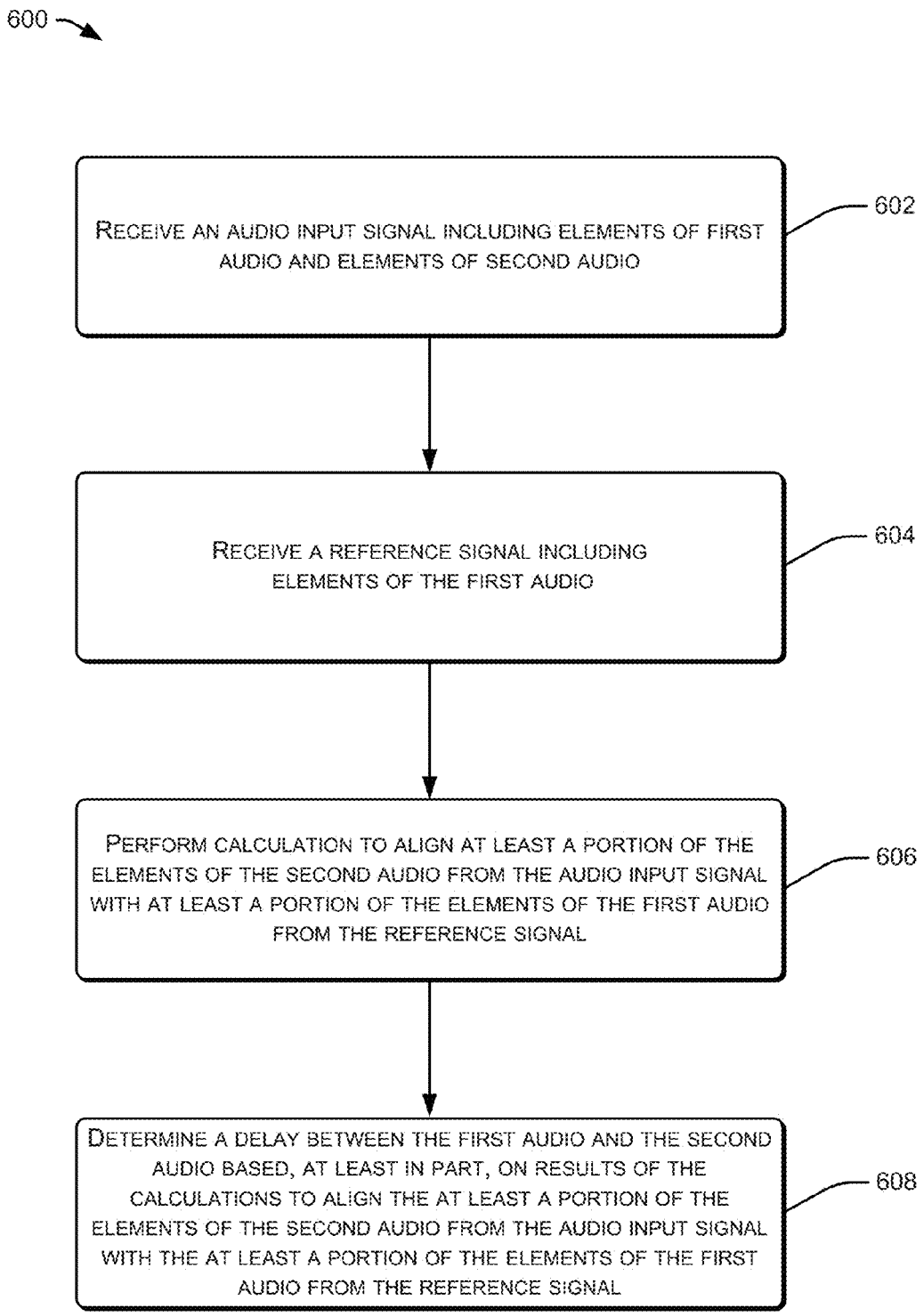
FIG. 6 is a flow diagram illustrating a first example process to synchronize audio transmitted by multiple electronic audio devices.
Figure 7:
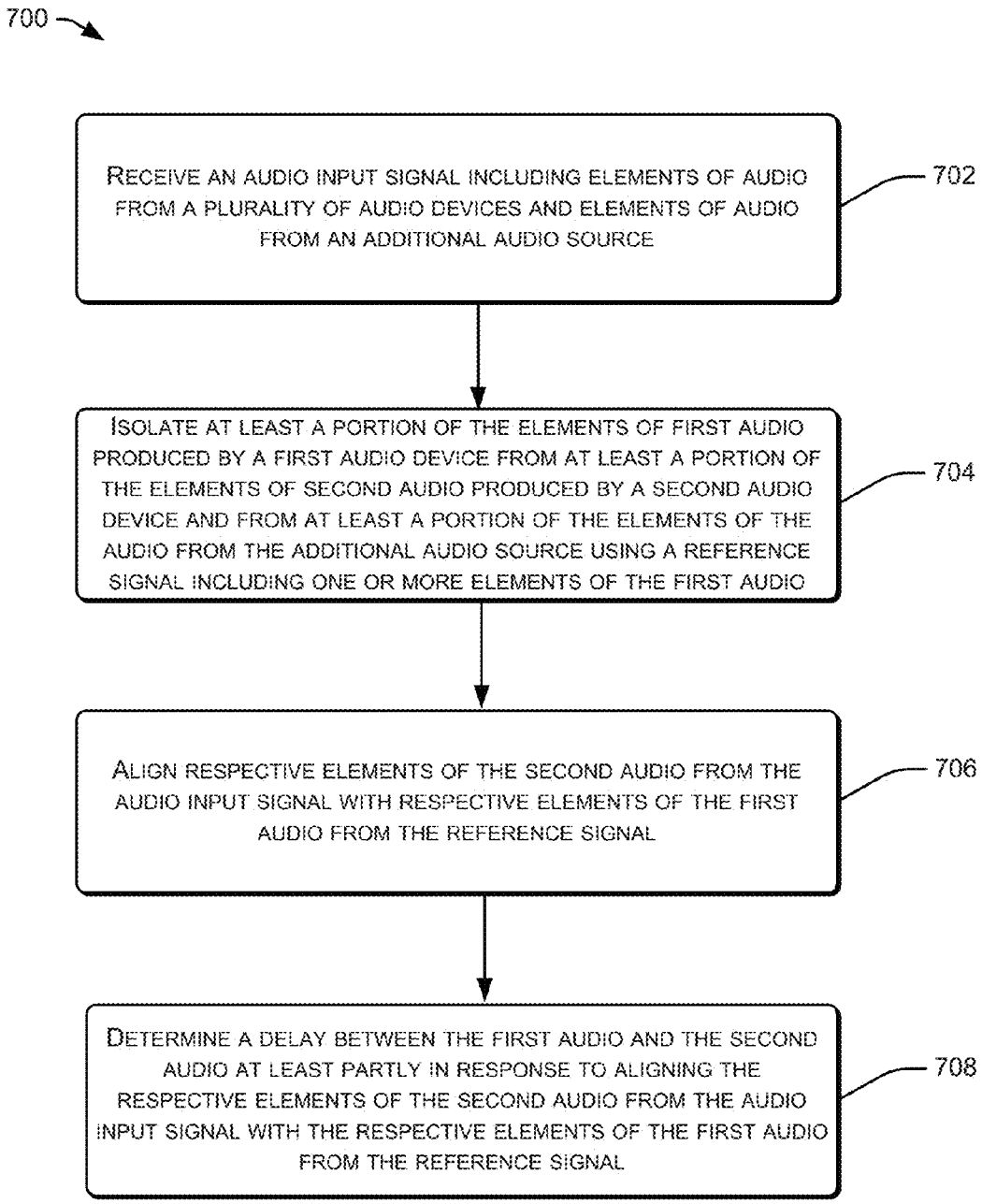
FIG. 7 is a flow diagram illustrating a second example process to synchronize audio transmitted by multiple electronic audio devices.

FIGS. 6 and 7 are flow diagrams illustrating example processes for synchronizing audio output from a number of electronic audio devices according to some implementations. The processes are illustrated as a collection of blocks in a logical flow diagram, which represent a sequence of operations, some or all of which can be implemented in hardware, software or a combination thereof. In the context of software, the blocks represent computer-executable instructions stored on one or more computer-readable media that, when executed by one or more processors, perform the recited operations. Generally, computer-executable instructions include routines, programs, objects, components, data structures and the like that perform particular functions or implement particular abstract data types. The order in which the operations are described should not be construed as a limitation. Any number of the described blocks can be combined in any order and/or in parallel to implement the process, or alternative processes, and not all of the blocks need be executed. For discussion purposes, the processes herein are described with reference to the frameworks, architectures and environments described in the examples herein, although the processes may be implemented in a wide variety of other frameworks, architectures or environments. In some cases, the processes of FIGS. 6 and 7 may be implemented with respect to the first environment 100, the second environment 200, the third environment 300, and/or the fourth environment 400. In other situations, the processes of FIGS. 6 and 7 may be implemented according to one or more additional environments.

FIG. 6 is a flow diagram illustrating a first example process 600 to synchronize audio transmitted by multiple electronic audio devices. At 602, the process 600 includes receiving an audio input signal including elements of first audio and elements of second audio. In addition, at 604, the process 600 includes receiving a reference signal including elements of the first audio.

At 606, the process 600 includes performing calculations to align at least a portion of the audio input signal corresponding to elements of the second with at least a portion of the reference signal corresponding to elements of the first audio. In an implementation, performing the calculations to align at least a portion of the input audio signal corresponding to elements of the second audio with at least a portion of the reference signal corresponding to elements of the first audio includes generating a cross-correlation function for a first function representing a signal corresponding to the elements of the first audio and a second function representing a signal corresponding to the elements of the second audio. In an illustrative implementation, the cross-correlation function may indicate a delay at which a maximum correlation occurs between the first function and the second function. In this way, the cross-correlation function may indicate an amount of time to shift the first function and the second function with respect to each other such that the signal of the first function and the signal of the second function are aligned.

At 608, the process 600 includes determining a delay between the first audio and the second audio based, at least in part, on results of the calculations to align the at least a portion of the audio input signal corresponding to elements of the second audio with the at least a portion of the reference signal corresponding to elements of the first audio. The delay may be determined in some scenarios by determining a maximum of the cross-correlation function.

In some implementations, the delay may be a first delay indicating that the elements of the second audio are delayed by a first period of time with respect to the elements of the first audio. Additionally, the audio input signal may include elements of third audio, and the process 600 may include determining a second delay between the first audio and the third audio. The second delay may indicate that the elements of the third audio are delayed by a second period of time with respect to the elements of the first audio.

Furthermore, the process 600 may, in some implementations include determining a third delay between the second audio and the third audio. The third delay may indicate that the elements of the third audio are delayed by a third period of time with respect to the elements of the second audio. In some scenarios, the process 600 may include determining that the third period of time is greater than the first period of time and that the third period of time is greater than the second period of time and delaying transmission of additional first audio according to the second period of time. In various implementations, the process 600 may also include sending a signal to a second audio device to delay transmission of additional second audio according to the third period of time. In alternative implementations, the process 600 may include sending a first signal to a first audio device to delay transmission of additional first audio according to the second period of time, and sending a second signal to a second audio device to delay transmission of additional second audio according to the third period of time.

In a particular implementation, the first audio may be generated by a first audio device at a first location in an environment, the second audio may be generated by a second audio device at a second location in the environment, and the third audio may be generated by a third audio device at a third location in the environment. The locations of the first audio device, the second audio device, and the third audio device may cause audio output from the respective audio devices to be delayed with respect to one another. For example, when aligning the first audio, the second audio, and the third audio to a common point in the environment (e.g., a location of the first audio device, a location of a user), the delays between transmitting the first audio, the second audio, and the third audio may be based at least in part on distances between the respective audio devices outputting audio into the environment. To illustrate, the first audio device and the second audio device may be separated by a first distance, the first audio device and the third audio device may be separated by a second distance, and the second audio device and the third audio device may be separated by a third distance. In a situation where the first distance is different from the second distance, the delay of the second audio with respect to the first audio device may be different from the delay of the third audio with respect to the first audio device. Additionally, the delay of the second audio with respect to the third audio may also be different.

FIG. 7 is a flow diagram illustrating a second example process 700 to synchronize audio transmitted by multiple electronic audio devices. At 702, the process 700 may include receiving an audio input signal corresponding to elements of audio from a plurality of audio devices and elements of audio from an additional audio source. In an implementation, the first audio may be generated from first audio content and the second audio may be generated from second audio content different from the first audio content. In other implementations, the first audio and the second audio may be generated from substantially the same audio content. In an illustrative implementation, the audio devices may be configured to provide stereophonic sound. In another illustrative implementation, the audio devices may be configured to provide surround sound. In addition, the elements of audio from an additional source include human speech. Further, in some scenarios, the audio input signal is received from an array of microphones receiving the audio from the plurality of audio devices, the array of microphones being remote from each audio device of the plurality of audio devices.

At 704, the process 700 may include isolating at least a first portion of an audio input signal corresponding to the elements of first audio produced by a first audio device from at least a second portion of the audio input signal corresponding to the elements of second audio produced by a second audio device and from at least a third portion of the audio input signal corresponding to the elements of the audio from the additional source using a reference signal. The reference signal may correspond to one or more elements of the first audio. The first portion of the audio input signal may be isolated from the second portion of the audio input signal and the third portion of the audio input signal by subtracting from the audio input signal the second portion and the third portion.

At 706, the process 700 may include determining a delay between the first audio and the second audio at least partly in response to performing calculations to determine a maximum amount of correlation between the portion of the input audio signal corresponding to the one or more elements of the second audio and the portion of the reference signal corresponding to the one or more elements of the first audio. The delay may indicate a period of time that the elements of the second audio are delayed with respect to the first audio.

In some cases, the period of time that the elements of the second audio are delayed with respect to the first audio is a first period of time, and the process 700 may include isolating a first portion of the audio input signal corresponding to elements of the second audio from a second portion of the audio input signal corresponding to elements of the first audio and from a third portion of the audio input signal corresponding to elements of the audio from the additional source using an additional reference signal. The additional reference signal may correspond to at least a portion of the elements of the second audio. In these situations, the process 700 may also include performing calculations to determine a maximum amount of correlation between a portion of the audio input signal corresponding to one or more elements of the first audio and a portion of the additional reference signal corresponding to one or more elements of the second audio from the additional reference signal. Furthermore, the process 700 may include determining an additional delay between the first audio and the second audio at least partly in response to performing calculations to determine a maximum amount of correlation between the portion of the audio input signal corresponding to the one or more elements of the first audio and the portion of the additional reference signal corresponding to the one or more elements of the second audio. The additional delay may indicate a second period of time that the elements of the first audio are delayed with respect to the second audio. Furthermore, the process 700 may include determining that the second period of time is greater than the first period of time; and delaying transmission of additional first audio for a third period of time based at least in part on a difference between the second period of time and the first period of time.

Although the subject matter has been described in language specific to structural features, it is to be understood that the subject matter defined in the appended claims is not necessarily limited to the specific features described. Rather, the specific features are disclosed as illustrative forms of implementing the claims.

Furthermore, this disclosure provides various example implementations, as described and as illustrated in the drawings. However, this disclosure is not limited to the implementations described and illustrated herein, but can extend to other implementations, as would be known or as would become known to those skilled in the art. Reference in the specification to "one implementation," "this implementation," "these implementations" or "some implementations" means that a particular feature, structure, or characteristic described is included in at least one implementation, and the appearances of these phrases in various places in the specification are not necessarily all referring to the same implementation.

What is claimed is:

1. An audio device comprising:

a first speaker to output first audio;

a first microphone to capture elements of the first audio and to capture elements of the second audio from a second speaker of an additional audio device, wherein the first microphone produces an audio input signal corresponding to the elements of the first audio and the elements of the second audio;

a second microphone to capture the elements of the first audio and to capture a portion of the elements of the second audio, wherein the second microphone produces a reference signal that corresponds to the elements of the first audio and the portion of the elements of the second audio;

one or more processors;

one of more computer-readable storage media in communication with the one or more processors, the one or more computer-readable storage media including instructions executable by the one or more processors to perform operations comprising:

isolating a portion of the audio input signal corresponding to one or more of the elements of the second audio to produce a modified input signal by subtracting a portion of the reference signal corresponding to the elements of the first audio from the audio input signal;

generating a cross-correlation function that indicates, for each of a plurality of delays, an amount of correlation between the portion of the reference signal corresponding to the elements of the first audio and the modified input signal;

determining a delay of the plurality of delays corresponding to the amount of correlation between the portion of the reference signal corresponding to the elements of the first audio and the modified input signal being at a maximum; and outputting additional audio from the first speaker that is delayed by an amount of time of the delay.

2. The audio device of claim 1, wherein:

the audio device is located at a first location; and the operations further comprise determining a second location that is remote from the first location by receiving a signal including a distance measurement indicating a distance between the first location and the second location or receiving a signal indicating a difference between a time of arrival of the first audio from the first speaker at the second location and a time of arrival of the second audio from the second speaker at the second location.

3. The audio device of claim 2, wherein:

the operations further comprise determining an estimated amount of time for sound to travel from the first location to the second location; and the additional audio output from the first speaker is delayed by an amount of time between the second microphone capturing the elements of the first audio and the first microphone capturing the elements of the second audio and the estimated amount of time for sound to travel from the first location to the second location.

4. A computing device, comprising:

one or more processors;

one of more computer-readable storage media in communication with the one or more processors, the one or more computer-readable storage media including instructions executable by the one or more processors to perform operations comprising:

receiving an audio input signal corresponding to elements of first audio and elements of second audio;

receiving a reference signal corresponding to the elements of the first audio;

aligning at least a portion of the audio input signal that corresponds to at least a portion of the elements of the second audio with at least a portion of the reference signal that corresponds to at least a portion of the elements of the first audio; and determining a delay between the first audio and the second audio based, at least in part, on the aligning.

5. The computing device of claim 4, wherein:

the computing device is a first audio device, the first audio is produced by the first audio device, and the second audio is produced by a second audio device; and the operations further comprise receiving an additional reference signal corresponding to the elements of the second audio.

6. The computing device of claim 5, wherein:

the delay is a first delay, the first delay indicating that the elements of the second audio are delayed by a first period of time with respect to the elements of the first audio;

the audio input signal includes elements of third audio produced by a third audio device, and the operations further comprise:

determining a second delay between the first audio and the third audio by aligning at least a portion of the audio input signal that corresponds to at least a portion of elements of the third audio with the at least a portion of the reference signal that corresponds to the at least a portion of the elements of the first audio, the second delay indicating that the elements of the third audio are delayed by a second period of time with respect to the elements of the first audio; and determining a third delay between the second audio and the third audio by aligning the at least a portion of the audio input signal that corresponds to the at least a portion of elements of the third audio with at least a portion of the additional reference signal that corresponds to at least a portion of the elements of the second audio, the third delay indicating that the elements of the third audio are delayed by a third period of time with respect to the elements of the second audio.

7. The computing device of claim 5, wherein the operations further comprise:

determining that the second period of time is greater than the first period of time and that the second period of time is greater than the third period of time; and in response to determining that the second period of time is greater than the first period of time and that the second period of time is greater than the third period of time, delaying transmission of the first audio according to the second period of time.

8. The computing device of claim 7, wherein the operations further comprise:

in response to determining that the second period of time is greater than the first period of time and that the second period of time is greater than the third period of time, sending a signal to the second audio device to delay transmission of the second audio according to the third period of time.

9. The computing device of claim 4, wherein the operations further comprise delaying output of the first audio from a speaker of the computing device according to the delay.

10. The computing device of claim 4, wherein the operations further comprise generating a cross-correlation function to align the at least a portion of the audio input signal that corresponds to the at least a portion of the elements of the second audio with at least the portion of the reference signal that corresponds to the at least a portion of the elements of the first audio.

11. The computing device of claim 10, wherein the operations further comprise identifying a maximum of the cross-correlation function that indicates the delay.

12. A method, comprising:

receiving an audio input signal corresponding to elements of respective audio from a plurality of audio devices and elements of audio from an additional audio source;

receiving a reference signal corresponding to one or more elements of first audio produced by a first audio device of the plurality of audio devices;

isolating a portion of the audio input signal corresponding to one or more elements of second audio produced by a second audio device of the plurality of audio devices by subtracting from the audio input signal a portion of the reference signal corresponding to the one or more elements of the first audio from the audio input signal and by subtracting from the audio input signal a portion of the audio input signal corresponding to at least a portion of the elements of the audio from the additional audio source; and determining a delay between the first audio and the second audio at least partly in response to performing calculations to determine a maximum amount of correlation between the portion of the input audio signal corresponding to the one or more elements of the second audio and the portion of the reference signal corresponding to the one or more elements of the first audio, the delay indicating a period of time that the first audio is to be delayed from transmission or output with respect to the second audio.

13. The method of claim 12, wherein the first audio is generated from first audio content; and the second audio is generated from second audio content different from the first audio content.

14. The method of claim 12, wherein the period of time is a first period of time, and the method further comprising:

receiving an additional reference signal corresponding to the one or more elements of the second audio;

isolating a portion of the audio input signal corresponding to the one or more elements of the first audio by subtracting from the audio input signal a portion of the additional reference signal corresponding to the one or more elements of the second audio and subtracting from the audio input signal the portion of the audio input signal corresponding to the at least a portion of the elements of the audio from the additional audio source; and determining an additional delay between the first audio and the second audio at least partly in response to performing additional calculations to determine a maximum amount of correlation between the portion of the input audio signal corresponding to the one or more elements of the first audio with the portion of the additional reference signal corresponding to the one or more elements of the second audio, the additional delay indicating a second period of time that the elements of the second audio are to be delayed from transmission or output with respect to the first audio.

15. The method of claim 14, further comprising:

determining that the second period of time is greater than the first period of time; and in response to determining that the second period of time is greater than the first period of time, delaying transmission or output of the first audio for a third period of time based at least in part on a difference between the second period of time and the first period of time.

16. The method of claim 14, further comprising:

sending a first signal to the first audio device to delay transmitting or outputting the first audio according to the delay; and sending a second signal to the second audio device to delay transmitting or outputting the second audio according to the additional delay.

17. The method of claim 12, further comprising:

determining that the delay is greater than or equal to a threshold delay; and transmitting the first audio according to the delay at least partly in response to determining that the delay is greater than or equal to the threshold delay.

18. The method of claim 12, further comprising:

transmitting a first portion of the first audio according to a first portion of the delay; and transmitting a second portion of the first audio according to a second portion of the delay.

19. The method of claim 12, wherein the elements of the audio from the additional source include human speech.

20. The method of claim 12, wherein the audio input signal is received from an array of microphones receiving the respective audio from the plurality of audio devices, the array of microphones being remote from each audio device of the plurality of audio devices.

* * * * *